United States Patent [19]

Lakey

[11] Patent Number: 5,072,575

[45] Date of Patent: Dec. 17, 1991

[54] METHOD OF FEEDING ARTICLES INTO A HORIZONTAL WRAPPING MACHINE

[76] Inventor: Lawrence D. Lakey, 4628 O'Connor Ct., Irving, Tex. 75062

[21] Appl. No.: 609,261

[22] Filed: Nov. 5, 1990

Related U.S. Application Data

[62] Division of Ser. No. 387,959, Jul. 31, 1989, Pat. No. 4,967,541.

[51] Int. Cl.[5] ..... B65B 35/24; B65B 9/20

[52] U.S. Cl. ..... 53/450; 198/477.1; 198/732; 198/734; 198/562; 198/617; 198/735.1

[58] Field of Search ..... 198/477.1, 732, 734, 198/735, 562, 717, 728, 727, 617; 53/450, 550, 553, 259, 260, 258

[56] References Cited

U.S. PATENT DOCUMENTS

| | | | |
|---|---|---|---|
| 1,767,824 | 6/1930 | Voigt | 53/259 X |
| 3,217,464 | 11/1965 | Feingold | 53/259 X |
| 3,217,857 | 11/1965 | Ellis et al. | 198/732 X |
| 3,472,556 | 10/1969 | Bolton | 198/732 X |
| 3,504,784 | 4/1970 | Noyes | 53/259 X |
| 3,513,629 | 5/1970 | Hoagland et al. | 53/550 |
| 3,527,337 | 9/1970 | Formo | 53/259 X |
| 3,615,002 | 10/1971 | Bolton | 198/732 |
| 3,916,597 | 11/1975 | Martelli | 53/550 X |
| 4,035,984 | 7/1977 | Gerlach et al. | 53/550 X |
| 4,101,020 | 7/1978 | Langen | 198/732 X |
| 4,185,443 | 1/1980 | Budzyn | 53/258 X |
| 4,218,863 | 6/1981 | Suga | 53/550 X |
| 4,430,844 | 2/1984 | James | 53/550 X |
| 4,464,883 | 8/1984 | Glover | 53/550 |
| 4,506,488 | 3/1985 | Matt et al. | 53/55 |
| 4,514,963 | 5/1985 | Bruno | 53/493 |
| 4,525,977 | 7/1985 | Matt | 53/55 |
| 4,553,368 | 11/1985 | Ziller | 53/51 |
| 4,574,566 | 3/1986 | Eaves et al. | 53/450 |
| 4,624,100 | 11/1986 | Lesch | 53/550 |

*Primary Examiner*—Horace M. Culver

*Attorney, Agent, or Firm*—Hubbard, Thurman, Tucker & Harris

[57] ABSTRACT

An inverted horizontal wrapping machine is provided with an article infeed system which includes a horizontal feed trough with an open exit end positioned closely adjacent the inlet end of the wrapping material tube being continuously formed by the machine's forming box. Offset to one side of the trough is a looped drive chain structure which is rotated in an essentially horizontal plane. A spaced series of flag-type pusher members are pivotally secured to the chain structure for movement therewith, the flag portions of the pusher members along the inner side of the chain structure being swept through the trough to slide articles therein sequentially into the tube inlet. As each pusher flag reaches the exit end of the trough, a first cam element upwardly and rearwardly pivots the flag to disengage it from its associated article, and the pivoted flag is then moved horizontally away from the trough . A second cam element re-pivots each flag to its downwardly extending article-engaging position prior to its re-entry into the trough. The outer ends of the flags may be provided with projections receivable in corresponding slots in the bottom trough surface to facilitate the feeding of otherwise difficult articles such as plastic forks.

7 Claims, 3 Drawing Sheets

METHOD OF FEEDING ARTICLES INTO A HORIZONTAL WRAPPING MACHINE

This application is a division application Ser. No. 387,959, filed July 31, 1989, now issued as U.S. Pat. No. 4,967,541.

BACKGROUND OF THE INVENTION

The present invention relates generally to material handling apparatus and, in a preferred embodiment thereof, more particularly provides a horizontal wrapping machine having an improved article infeed system which permits the machine to be operated with substantially improved speed, reliability and safety.

Horizontal wrapping machines are well known in the material handling art and are utilized to automatically wrap a wide variety of articles in separate packages formed from a continuous sheet of flexible wrapping material supplied to the machine from a large supply roll. Conventional wrapping machines of the type schematically illustrated, for example, in FIG. 1 of U.S. Pat. No. 4,574,566 to Eaves et al., typically include a film forming box for shaping a continuous film of packaging material into a continuous tube; a film drive for operatively drawing the film through the forming box and past a cutting and sealing station; a product infeed drive for feeding products to be packaged through the forming box into the continuous tube of packaging material so that the products are spaced apart from one another in the tube; and a driven rotary cut/seal head at the cutting and sealing station for cutting and sealing the continuous tube of packaging material, to form individual packages, as each product moves through that station.

In conventional wrapping machines of this type, the wrapping material is fed generally downwardly and forwardly to the forming box which operates to downwardly fold and bring together opposite side edge portions of the material which are thereafter sealed together to form the continuous tube. At the rear end of the forming box the tube has an open inlet end into which the products or articles are inserted by means of an endless, multi-link infeed conveyor divided into a series of product-containing flights by spaced apart product pushers or "dogs" carried by the conveyor.

The tube inlet opening rearwardly and upwardly overlaps the discharge end of the conveyor and has a generally V-shaped open bottom portion defined by the down-folded side edge portions of the wrapping sheet as they are being brought together by the forming box to close the tube. Accordingly, the lead drive dog of the conveyor is driven forwardly a substantial distance into the tube inlet opening before dropping through a support plate slot on its way to the rear end of the conveyor. Just prior to dropping through this slot, the lead dog pushes its driven article onto a transfer plate positioned within the forming box just rearwardly of the point at which the down-folded side edges of the wrapping material are laterally brought together to close the tube at the forward end of the forming box. The converging side edge portions of the closing tube grip the article deposited on the transfer plate and forwardly transport it past the front end of the forming box, at which point the tube closes around the article.

As is well known in the wrapping art, this product infeed system can create a variety of problems in the overall operation of the wrapping machine. For example, the lead drive dog can easily tip its delivered article rearwardly and downwardly into the support plate slot through which the lead drive dog drops at the front end of the feed conveyor, thereby causing the article to fall out of the tube, to be crushed as it passes through the cutting and sealing station, or to jam the machine. Additionally, the driven article, as its front end reaches the support plate slot, can tip forwardly into the support plate slot and cause similar problems. Further, there is often a tendency for articles (particularly small ones) to stall on the transfer plate.

Additionally, the necessary entry of each lead drive dog into the tube inlet area can, depending on the conveyor speed, impart an undesirably high degree of forward momentum to the article being inserted into the tube. This, in turn, requires that the end-to-end length of each package be oversized relative to the length of the product being wrapped. The additional wrapping material required, of course, undesirably increases the per article wrapping cost.

To overcome these problems, attempts have been made to use "fall back" drive dogs on the conveyor system. In this conveyor system modification, each drive dog along the top side of the conveyor belt is held upright until it reaches the discharge end of the conveyor, at which time it is permitted to fall rearwardly (by gravity) onto the belt before dropping through the support plate slot. While in theory this would seem to solve both the excess article momentum problem, and the tendency to rearwardly tip the inserted article, neither problem is completely alleviated. For example, as the machine speed is increased, a point is reached at which the gravity fall back of each lead drive dog is simply not fast enough to avoid excessive forward force being imparted by the dog to the inserted article. If the machine is slowed to overcome this problem, the per article wrapping cost is increased. Additionally, at desirable higher machine speeds each lead dog (if not fully retracted by gravity) can still rearwardly tip the article which it is inserting into the tube inlet. Further, the presence of the support plate slot (through which the lead dog drops) can still permit the lead article to forwardly tip thereinto.

One approach to solving these article insertion and feed problems is to construct the wrapping machine in an "inverted" orientation in which the forming box is inverted, and the wrapping material is fed upwardly and forwardly to the rear end of the forming box. In this inverted machine configuration, the forming box upwardly folds side edge portions of the incoming wrapping material and positions the V-opening of the tube inlet above the closed bottom side of the tube inlet portion. This permits the inserted articles to be fed onto the closed side of the tube being continuously formed—at first glance providing the inverted machine with a considerable advantage over its non-inverted counterpart.

However, a considerable portion of this potential advantage is negated by the necessity of spacing the discharge end of the article feed conveyor rearwardly of the tube inlet to avoid interference between each downwardly moving lead dog and the now closed bottom side of the tube inlet. The rearward spacing of the conveyor belt requires the insertion between the belt and the tube inlet of a separate transfer plate onto which each article is deposited on its way into the tube inlet.

The presence of this interposed separate transfer plate requires an auxiliary feed system to slide each deposited article across the transfer plate into the tube inlet, thereby increasing the overall cost of the wrapping machine and adds another mechanical system which must be adjusted and serviced. Additionally, to prevent interference between the transfer plate and the conveyor drive dogs, the rear end of the transfer plate must be provided with a slot through which each lead dog may downwardly pass. This slot provides essentially the same opportunity for undesirable forward and rearward article tipping as the transfer plate within the tube inlet in the non-inverted wrapping machine. Moreover, the article momentum problem, associated with the inline drive dogs, remains.

From the foregoing it can be readily seen that a need exists in horizontal wrapping machinery for an improved article infeed system which eliminates or minimizes the above-mentioned and other problems, limitations and disadvantages typically associated with conventional infeed systems. It is accordingly an object of the present invention to provide such improved infeed system in a horizontal wrapping machine.

SUMMARY OF THE INVENTION

In carrying out principles of the present invention, in accordance with a preferred embodiment thereof, an inverted horizontal wrapping machine is provided with a specially designed article infeed system which essentially eliminates the feeding problems typically associated with horizontal wrapping machines of conventional design, and permits the machine to be reliably operated at considerably higher wrapping speeds.

The horizontal wrapping machine in which the improved article infeed system of the present invention is representatively incorporated is one of an "inverted" configuration in which the roll-stored wrapping sheet material is continuously fed generally upwardly and forwardly to the rear end of an inverted forming box, drawn forwardly through the forming box, and then moved through a cutting and sealing station which seals and separates the article-containing individual packages being formed. The inverted forming box functions, in a generally conventional manner, to upwardly fold opposite side edge portions of the wrapping sheet, relative to a bottom, laterally central portion thereof, to initiate the formation of a continuous wrapping material tube which is drawn through the cutting and sealing station. The tube has an open inlet end into which the articles to be wrapped are sequentially inserted and deposited onto the closed bottom side of the tube at its inlet end.

In its preferred embodiment, the article infeed system of the present invention includes a generally horizontally disposed elongated article feeding trough having an upwardly facing bottom support surface and an open exit end which faces and is disposed closely and rearwardly adjacent the open inlet end of the continuous tube. Importantly, there is no appreciable horizontal gap between the trough exit end and the rear end of the tube inlet opening.

Horizontally offset to one side of the trough is an elongated looped chain drive structure which is rotationally drivable in a generally horizontal plane. The looped drive chain longitudinally extends generally parallel to the trough, has a looped front end adjacent the exit end of the trough, and has an inner side portion which is laterally adjacent the trough and moves generally forwardly toward the trough exit end.

The pole portions of a series of pusher flag members are secured to horizontally spaced sections on the chain drive structure, for movement therewith, and project transversely outwardly from the chain structure in horizontal directions. Each of the pole portions is pivotable about its longitudinal axis to move its associated flag portion between a first position in which the flag extends downwardly from the outer end of its associated pole, and a second portion in which the flag is pivoted upwardly and rearwardly relative to the horizontal chain travel direction.

As they are moved toward the trough exit end by the inner side portion of the drive chain, the pusher flag pole portions overlie the trough with their flag portions extending downwardly into the trough and being held in their first positions by a stop bar which overlies cam follower wheels operatively mounted on crank arms at the inner ends of the pole portions. The downturned pusher flags are forwardly swept through the trough, with their bottom ends closely adjacent the bottom support surface of the trough, to slide a spaced series of articles to be wrapped toward the trough exit end.

As each flag approaches the trough exit end it pushes its associated article off the exit end and directly onto the bottom side of the continuously forming wrapping material at the inlet opening of the tube. When this lead flag reaches the trough exit end, its associated cam follower wheel is moved past the overlying stop bar and is engaged by first cam means which operate to rearwardly and upwardly pivot the lead flag to its second position in which it is disposed above the height of its associated article. The upwardly and rearwardly pivoted lead flag is then swept horizontally away from the trough exit end by the forward end of the drive chain structure.

At or about the time each lead flag is chain-returned to the rear end of the trough, its associated cam follower wheel is engaged by second cam means which operate to forwardly and downwardly pivot the flag to its first position. As the flag enters the rear end of the trough its cam follower wheel is again positioned under the stop bar (thereby locking the flag in its first position) and the flag is again swept forwardly through the trough, toward its exit end, to slide another article along the trough and deposit the article into the tube inlet.

Importantly, because each successive lead flag is upwardly and rearwardly pivoted out of engagement with its associated article at the trough exit end, and is then swept horizontally away from the article feed trough, none of the pusher flags enters the tube inlet end or tends to forwardly or rearwardly tip the articles as they are being pushed into the tube. Further, since there is no gap or slot at the trough exit end through which the lead flags must downwardly pass, there is no opening into which the inserted articles can fall and be crushed and/or cause jamming of the machine. Additionally, this flag positioning movement feature of the present invention essentially eliminates the excess article momentum problem present in conventional in-line dog type conveying systems. In turn, this greatly reduces the need to oversize the lengths of the individual packages.

These significant advantages permit the wrapping machine to be very reliably operated at substantially higher speeds than those of wrapping machines with conventional article infeed systems. The quite beneficial result is that a higher production volume may be achieved at a lower cost per packaged article.

The horizontal offsetting from the trough of the drive means for the pusher flag elements also facilitates the safe and quite easy top loading of the trough (either manually or with an automated loading system) of articles to be wrapped. While it is preferable that the horizontally offset flag drive chain be disposed to rotate in an essentially horizontal plane (thereby moving each lead flag horizontally away from the tube inlet), the drive chain could also be oriented to rotate in an essentially vertical plane, in which case each successive lead flag (after rearward pivoting thereof) would be swept away from the tube inlet in a generally upward direction. As used herein, an indication that, adjacent the trough exit end, each flag it moved "away from" the trough support surface, the trough exit end, or the tube inlet is meant to cover either a generally lateral horizontal movement of the flag, a generally upward flag movement thereof, or any flag movement direction in between. Additionally, the term "horizontally offset", with reference to position of the looped drive chain structure relative to the article feed trough, is intended to cover either a full horizontal offset, or partial horizontal offset, of the looped drive means structure relative to the feed trough or its bottom support surface.

While in its preferred embodiment the article infeed system of the present invention utilizes "flag" shaped pusher elements it will be readily appreciated that a wide variety of alternate pusher element configurations could be used if desired. Moreover, these alternately configured pusher elements could be used in conjunction with feed troughs having a variety of complementary cross-section configurations.

According to a feature of the present invention, the outer end of each pusher element flag portion has formed thereon a spaced series of generally V-shaped projections. The upwardly facing bottom support surface of the feed trough is essentially flat, and has formed therein a spaced series of longitudinally extending V-shaped grooves which receive the flag end projections as the flags, in their first positions, are forwardly moved through the trough. This feature significantly facilitates the feeding of lightweight and otherwise difficult articles such as, for example, plastic forks.

DETAILED DESCRIPTION

Figure 1:
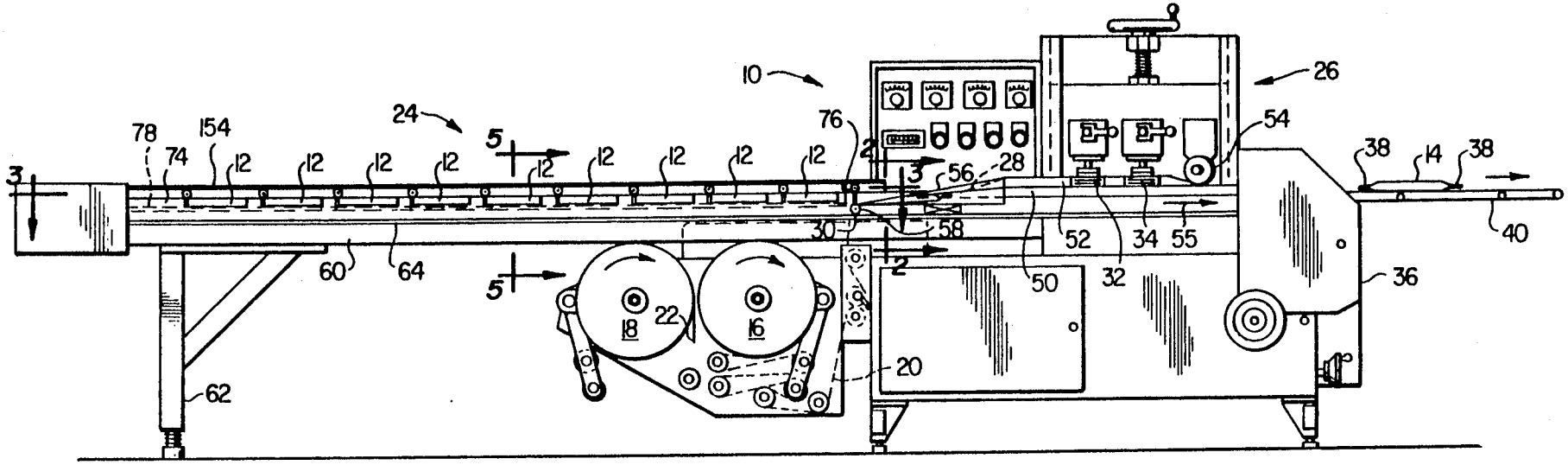
FIG. 1 is a simplified, somewhat schematic side elevational view, partially in cross-section, of an inverted horizontal article wrapping machine into which is incorporated an improved article infeed system embodying principles of the present invention.

Illustrated in FIG. 1 is an "inverted" horizontal wrapping machine 10 which is used to individually wrap articles 12 at a high speed in separate packages 14 exiting the machine and continuously formed from supply rolls (an in-use supply roll 16, and a standby supply roll 18) of elongated flexible wrapping sheet material 20, 22 supported on a lower central portion of the machine. With the exception of a unique article infeed system 24 embodying principles of the present invention and described in detail below, and a modified forming box later described, the wrapping machine 10 is generally conventional in construction and operation, and includes a wrapping section 26 positioned to the right of the wrapping material supply rolls 16, 18 and the improved infeed system 24 of the present invention.

The wrapping section 26 is provided, adjacent its left end, with an inverted forming box 28 having a leftwardly disposed inlet end to which the elongated wrapping material sheet 20 is continuously fed after its passage over a guide roller 30 which, according to a feature of the present invention, is secured to the inlet end of the forming box. The wrapping material sheet 20 is drawn rightwardly through the forming box 28 by the driven rotation of a pair of fin crimping roller sets 32 and 34, and the driven rotation of opposed cutting and sealing bars (not visible) disposed in a cutting and sealing station 36 positioned at the right end of the wrapping section 26. These cutting and sealing bars operate to crimp, seal and cut apart the opposite ends 38 of the individual packages 14 which are discharged from the cutting and sealing station 36 onto a discharge conveyor 40.

Figure 2:
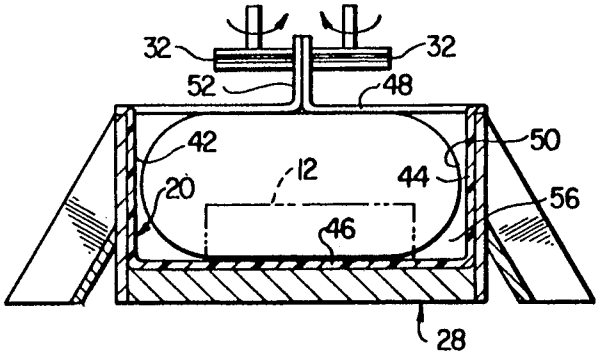
FIG. 2 is an enlarged scale schematic cross-sectional view taken through the wrapping material tube forming portion of the machine along line 2—2 of FIG. 1.

Referring briefly to FIG. 2 the inverted forming box 28 functions in a generally conventional manner to upwardly fold opposite side edge portions 42 and 44 of the wrapping material sheet 20 relative to a laterally central bottom base portion 46 thereof. As the sheet 20 is drawn forwardly through the forming box 28, these upwardly folded side edge portions 42, 44 are brought together, along an open V-shaped area 48 at the top of the folded sheets, to form a rightwardly moving tube 50, having, along its top side, an upwardly projecting fin 52 defined by side edges of the sheet 20 which been brought together by the forming box 28.

As the upright fin 52 is drawn through the roller sets 32 and 34, it is conventionally crimped and sealed by such roller sets. The crimped and sealed fin 52 is then folded over onto the tube 50 as the fin is drawn under a foldover roller 54. The tube 50 with its folded-over fin 52 is then drawn through the cutting and sealing station 36, the previously mentioned rotating bars therein operating to form and seal the package ends 38, and cut the sealed ends apart to form the illustrated individual packages 14 exiting the machine 10, each of the packages 14 sealingly containing one of the articles 12.

The continuously forming tube 50, being drawn rightwardly through the wrapping section 26 as indicated by the arrow 55 in FIG. 1, has a continuously maintained open inlet end 56 having a leading bottom edge 58 rightwardly adjacent the guide roller 30. This open inlet end 56 is bounded along its bottom side by the laterally central portion 46 of the wrapping sheet 20, and along its sides by the upturned side edge portions 42, 44 of the sheets. The inlet opening is bounded along its upwardly and rightwardly sloped top side by the V-shaped space 48 between the sheet side edge portions prior to the point at which they are brought together to form the tube fin 52 (FIG. 2).

It is into this open inlet end 56 that the illustrated articles 12 are sequentially deposited (by the article infeed system 24) and placed to rest upon the upper surface of the laterally central portion 46 of the wrapping sheet 20 at the tube inlet. The sequentially inserted articles 12 are carried rightwardly on this bottom sheet portion 46 and are subsequently transported rightwardly on the bottom side of the tube 50 as illustrated in FIG. 2. As will now be described, the unique configuration and operation of the article infeed system 24 permits the wrapping machine 10 to be reliably operated at considerably higher speeds than horizontal wrapping machines with conventional in-line article feed systems.

The Article Infeed System

Figure 5:
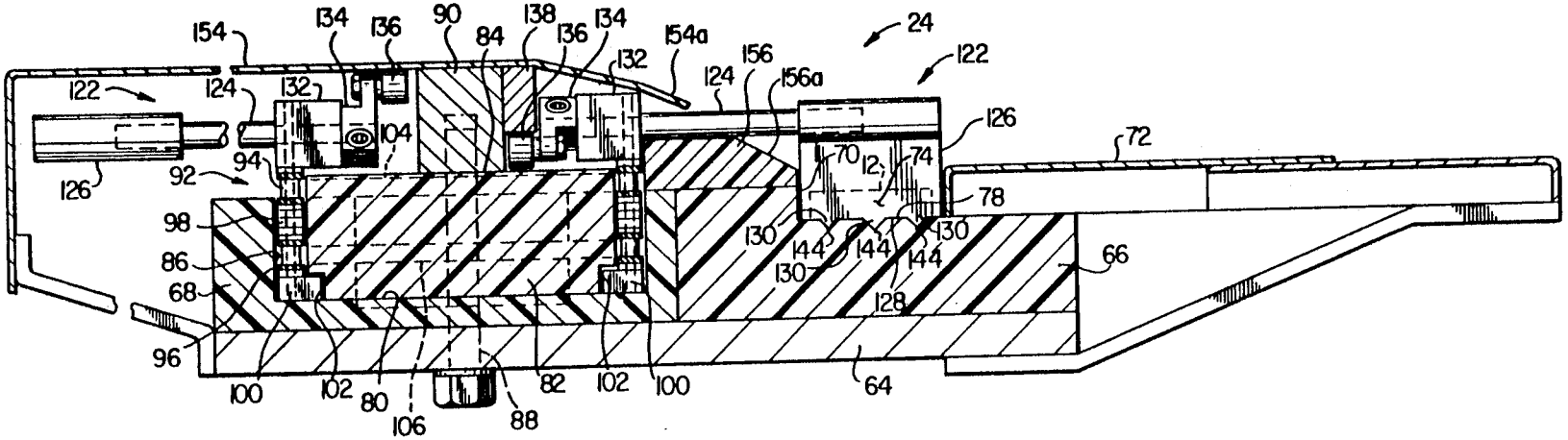
FIG. 5 is an enlarged scale, simplified cross-sectional view through the article infeed system taken along line 5—5 of FIG. 1.
Figure 7:
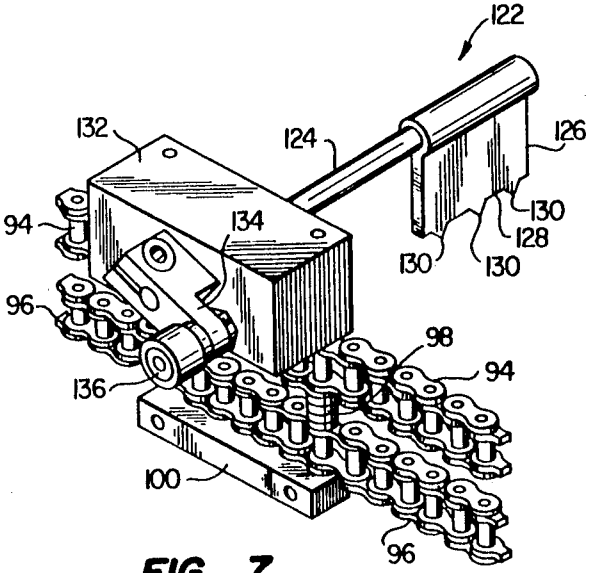
FIG. 7 is a perspective view of one of the pusher flag members of the infeed system illustrating its connection to an adjacent chain drive section.

Referring initially to FIGS. 1 and 5, the article infeed system 24 is basically an elongated structure which longitudinally extends rearwardly from adjacent the tube inlet opening 56 and is positioned over the alternately usable wrapping material supply rolls 16 and 18 which feed the wrapping sheet material generally upwardly and forwardly to the forming box 28 over the guide roller 30 secured to its leftwardly facing inlet end. The infeed system 24 is supported in this elevated position by rearwardly extending elongated support members 60 (FIG. 1) resting at their rear ends on braced floor support legs 62. Supported by the members 60, and extending along their lengths, is an elongated metal support plate 64 having secured to its upper side surface (see FIG. 5) laterally abutting elongated mounting members 66 and 68, each having a generally rectangular cross section and being formed from an ultra high molecular weight polyethylene material.

As can be best seen in FIG. 5, a right side portion of the member 66 is vertically inset to form along the length of such member a rightwardly facing ledge surface 70. A left side portion of an elongated, laterally outwardly projecting metal guide shelf 72 rests upon the upper side surface of the mounting member 66, rightwardly of the ledge 70, and defines with the ledge 70 an elongated article feed trough 74. The article feed trough 74 has an open exit end 76 (see also FIG. 3) which is positioned closely adjacent the left end of the tube inlet opening 56, and has an upwardly facing bottom side support surface 78 defined by a laterally central portion of the upper side surface of the mounting member 66.

Figure 4A:
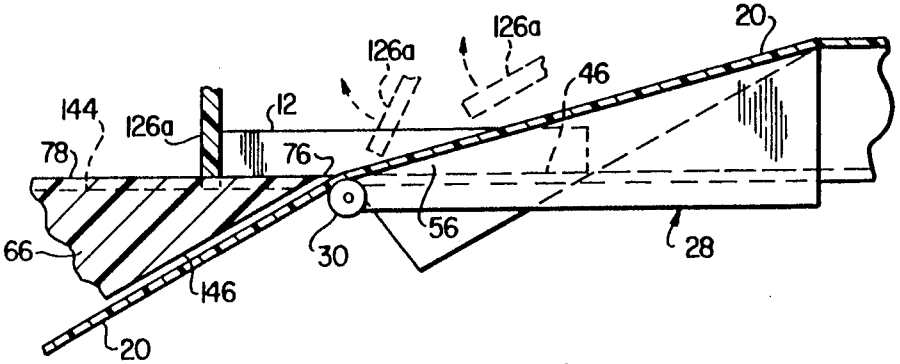
FIG. 4A is an enlargement of a right end portion of FIG. 4.
Figure 3:
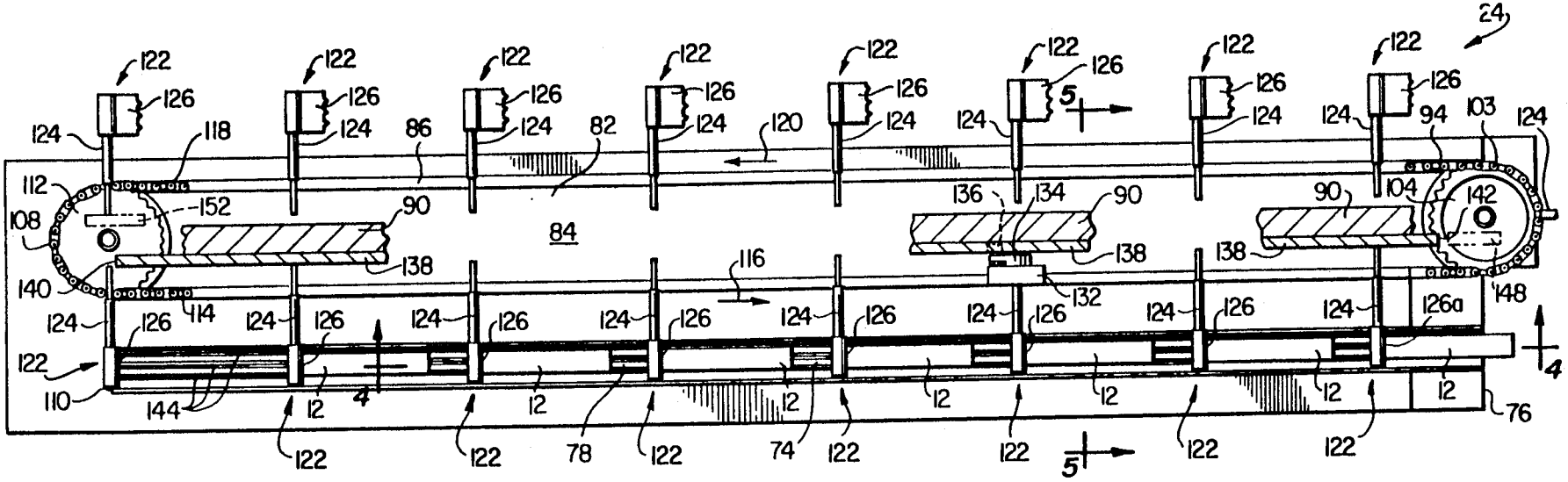
FIG. 3 is an enlarged scale, simplified cross-sectional view through the article infeed portion of the machine taken along line 3—3 of FIG. 1.
Figure 4:
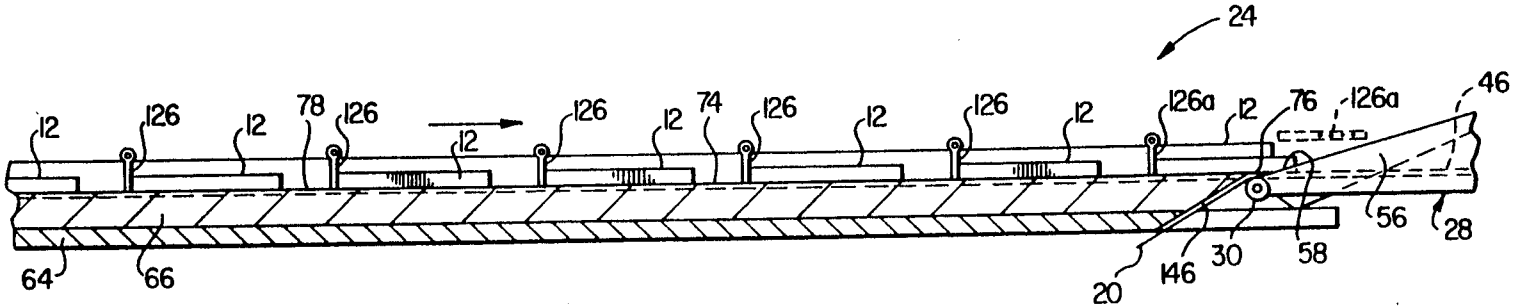
FIG. 4 is a simplified cross-sectional view through the article infeed system taken along line 4—4 of FIG. 3.

Referring now to FIGS. 3–5, the elongated mounting member 68 has formed along its length an elongated top side recess 80 which receives an elongated spacing member 82 which laterally projects upwardly past the upper side surface of the mounting member 68. The spacing member 82 is horizontally narrower than the width of the elongated slot 80 and defines within the mounting member 68 a drive chain slot 86 extending around its interior periphery. As illustrated in FIG. 5, the support plate 64, the mounting member 68 and the spacing member 82 are firmly clamped together by means of a spaced series of bolts 88 extending upwardly through these three elements and threaded into an elongated metal clamping bar member 90 extending upwardly along the length of the insert member 82.

The article infeed system 24 is provided with drive means 92 which, as viewed in FIG. 5, are horizontally offset leftwardly to one side of the article feed trough 74. The drive means 92 include an elongated, looped chain drive structure longitudinally extending parallel to the length of the feed trough 74 and defined by upper and lower looped roller chains 94 and 96 (see FIGS. 3 and 5–7). The upper and lower looped chains 94, 96 are vertically spaced apart from one another and are interconnected at longitudinally spaced locations thereon by suitable spacer elements 98. The drive chains 94, 96 are received within the drive chain slot 86 for movement therein through a closed path along an essentially horizontal plane, and are retained in the slot 86 by a spaced series of retaining blocks 100 secured to the lower chain 96 and projecting into bottom side edge slots 102 formed in the spacer member 82.

The looped front ends 103 of the drive chains 94, 96 extend around and are operatively engaged by upper and lower drive sprockets 104, 106 (see FIGS. 3, 5 and 6) positioned forwardly adjacent and to one side of the trough exit end 76. Sprockets 104, 106 are rotationally driven by a suitable drive (not illustrated in the drawings). The looped rear ends 108 of the drive chains 94, 96 (FIG. 3) are positioned rearwardly of and to one side of the open rear end 110 of the article feed trough 74 and are operatively engaged by a stacked pair of driven sprocket members 112 rotatably supported adjacent the rear end of the spacing member 82. During operation of the laterally offset drive means 92, the front sprockets 104 and 106, and the rear sprockets 112 are rotated in a counterclockwise direction as viewed in FIG. 3, the near sides 114 of the drive chains 94, 96 are driven forwardly as indicated by the arrow 116, and the far sides 118 of the chains 94, 96 are driven rearwardly as indicated by the arrow 120.

The schematically illustrated articles 12 are loaded into the trough 74 (either manually or with a suitable automated loading system) in a continuously maintained, longitudinally spaced array and are slidably pushed forwardly along the trough support surface 78 by a spaced series of pusher flag members 122 carried by the upper drive chain 94 for horizontal movement therewith. With reference now to FIGS. 3 and 5–7, each of the pusher flag members 122 includes an elongated pole portion 124 which projects laterally outwardly of the upper chain 94 in a horizontal plane disposed above the open top side of the article feed trough 74. Fixedly secured to the outer end of each of the pole portions 124 is a generally rectangular pusher flag 126 having an outer end edge 128 upon which a spaced series of generally V-shaped projections 130 are formed. These flag portions 126 are preferably formed from a wear resistant high density polymer material.

The pole portions 124 are extended inwardly through a spaced series of support block members 132 secured to the upper side of the upper drive chain 94 at spaced intervals thereon. The support poles 124 are rotatably relative to their associated support blocks 132 to pivot the pusher flags 126 between a first position in which the flags extend downwardly from the outer ends of the poles 124, and a second position in which the flags are rearwardly and upwardly pivoted (relative to the direction of drive chain travel) into a generally horizontal plane.

The inner ends of the flag poles 124 are fixedly secured to offset crank arm members 134 which carry cam follower wheels 136 at their outer ends. During counterclockwise rotation of the upper and lower drive chains 94, 96 (as viewed in FIG. 3), the flags 126 positioned along the near side 114 of the upper chain 94 are each held in their first position by their associated cam follower wheels 136 which are captively retained between the upper side surface of the insert member 82 and the underside of an elongated lock bar member 138 positioned above these near side cam follower wheels. As illustrated in FIGS. 3 and 5, the elongated lock bar 138 has a rear end 140 positioned longitudinally adjacent the open rear end 110 of the trough 74, and a front end 142 positioned somewhat forwardly of the trough exit end 76, and is secured to the clamping bar member 90 along the side thereof facing the article feed trough. It can be seen that while a given cam follower wheel 136 is positioned beneath the lock bar 138, its associated crank arm 134 is prevented from rotating, thereby locking the associated flag 126 in its downwardly extending first position.

Counterclockwise rotation of the upper and lower drive chains forwardly sweeps the near side pusher flags 126 through the trough 74 to forwardly slide the articles 12 along the trough support surface 78 toward the trough exit end 76. As these near side flags are forwardly swept through the trough, their lower end projections 130 are received in and swept forwardly through complementarily configured longitudinal grooves 144 formed in the support surface. This unique flag projection/support surface groove interaction conveniently permits the near side pusher flags to efficiently slide even very lightweight and otherwise difficult articles (such as, for example, plastic forks) forwardly along the trough support surface 78, past the trough exit end 76 and into the tube inlet end 56, without any appreciable tendency to jam the forwardly sliding article between the lower end of its pusher flag and the trough support surface.

Referring now to FIGS. 3, 4, 4A, and 6, as each of the pusher flags 126 comes to the front of the near side flag line, it becomes what may be termed a "lead" flag $\mathbf{126}_a$ and begins to slide its associated article 12 off the trough exit end 76, into the tube inlet end 56 and directly onto the forwardly moving laterally central portion 46 of the wrapping material sheet 20 at the left end of the forming box 28 as best illustrated in FIG. 4A. When the lead flag $\mathbf{126}_a$, still in its downwardly extending first position, reaches the exit end of the trough, the article 12 has been substantially entirely deposited on the laterally central sheet portion.

It is important to note that as the forwardmost article 12 is being deposited onto the laterally central wrapping sheet portion, it at no time passes over an opening into which it can fall or be forwardly or rearwardly tipped by the lead flag $\mathbf{126}_a$. Due to a unique positional relationship between the incoming wrapping sheet 20 and the exit end 76 of the article feed trough which will now be described, no such opening exists.

As best illustrated in FIG. 4A, the front end surface 146 of the mounting member 66 upon which the article feed trough 74 is positioned, is sloped downwardly and rearwardly away from the exit end 76 of the trough. As it is fed upwardly and forwardly to the guide roller 30, the wrapping material sheet 20 passes closely adjacent and parallel to this sloped surface 146 and then passes over the guide roller 30 which is positioned immediately forwardly of the trough exit end 76. Additionally, the guide roller 30, which is supported on the leftwardly disposed entrance end of the forming box 28, is vertically positioned to dispose the upper surface of the laterally central wrapping material sheet portion 46 in the same plane as the article feed trough support surface 78. Accordingly, such laterally central sheet portion 46 essentially defines a horizontal forward continuation of the trough's support surface 78.

Figure 6:
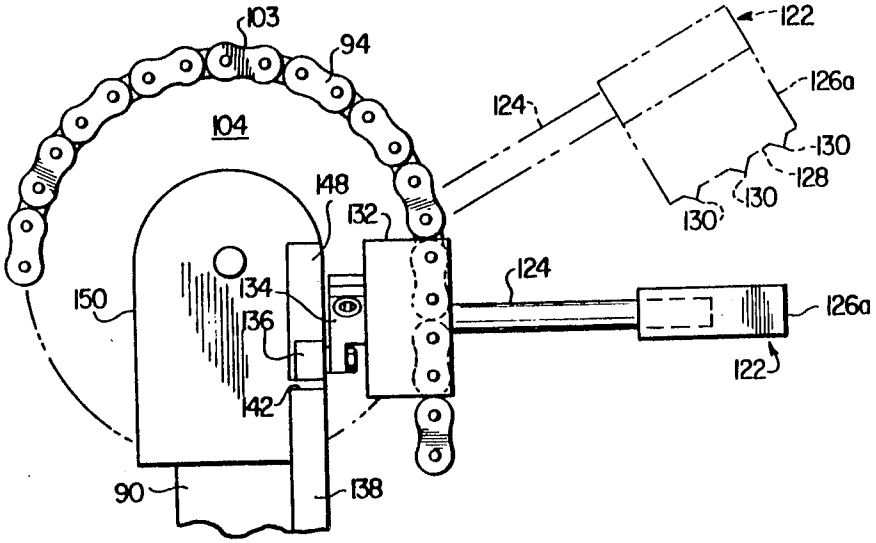
FIG. 6 is an enlarged scale, simplified top plan detail view of a front end portion of the article infeed system looped chain drive structure.

At or about the time the lead flag $\mathbf{126}_a$ reaches the trough exit end 76, the cam follower wheel 136 associated with the lead flag $\mathbf{126}_a$ moves rightwardly past the forward end 142 of the lock bar 138 (FIGS. 3 and 6) and is moved into engagement with an upwardly ramped cam surface 148 (schematically shown in phantom in FIG. 3). Cam surface 148 (FIG. 6) is formed along a side edge portion of an extension member 150 which is secured to the forward end of the clamping bar member 90 and overlies the upper drive sprocket 104. As illustrated in FIGS. 4, 4A and 6, as the cam follower wheel 136 is driven upwardly and forwardly along the ramped cam surface 148, its associated crank arm 134 is pivoted in a manner pivoting the lead flag from its solid line first position illustrated in FIG. 6 to its second position (illustrated in phantom in FIG. 6) in which the lead flag $\mathbf{126}_a$ is repositioned to a level above the top of the article 12 which its previously moved into the tube inlet end. As can be seen in FIG. 6, this forcible rearward and upward pivoting of the lead flag $\mathbf{126}_a$ is effected in a relatively short travel distance of such flag. Accordingly, the lead flag $\mathbf{126}_a$ is rapidly disengaged from its associated article 12 closely adjacent the exit end 76 of the article feed trough. Immediately after this forced pivotal movement of the lead flag, the lead flag is swept horizontally away from the trough 74, its exit end 76, and the tube inlet 56 as the lead flag is carried around the front end of the chain drive system.

Quite importantly, due to this unique pivoting and lateral sweeping away of each of the lead flags $\mathbf{126}_a$, none of the flags 126 appreciably enters the inlet end of the wrapping material tube. There is accordingly no direct contact between the pusher flags and the wrapping material and there is no tendency for the lead flags to cause article jamming in the machine or to impart excessive forward momentum to the articles as they are being delivered into the tube inlet.

After each of the lead flags $\mathbf{126}_a$ is rearwardly and upwardly pivoted adjacent the trough exit end, and swept laterally away from the trough, it is rearwardly returned by the far side of the upper drive chain to the rear end of the near side flag line. As each successive flag approaches the rear end of the chain drive system, its associated cam follower roller is engaged by a downwardly ramped cam surface 152 (schematically illustrated in phantom in FIG. 3) which is formed on an extension member (not illustrated), similar to the previously described extension member 150, secured to the rear end of the elongated clamping block 90 and overlying the uppermost rear driven sprocket 112. Interaction between the cam follower roller and the downwardly ramped cam surface 152 forcibly pivots each successive flag from its generally horizontal second position to its downwardly extending first position as the flag passes around the rear end of the chain drive system. Subsequently, as each successive flag approaches the open rear end 110 of the article trough 74, the flag's drive roller is brought beneath the lock bar 138 so that as the flag is swept forwardly through the trough 74 it remains locked in its first position as previously described.

In addition to the previously described article feed advantages of the infeed system 24, it also advantageously provides for very easy and a quite safe manual loading of the articles 2 into the trough 74. To facilitate such manual loading, a cover member 154 (FIG. 5) is suitably secured over the top of the drive means 92. An elongated near side portion $154_a$ of cover member 154 is downwardly ramped toward the trough 74 and terminates just above inner end portions of the near side pusher flag poles 124. Additionally, an elongated loading ramp member 156 is secured to the upper sides of the mounting members 66 and 68, laterally extends between the chain drive structure and the trough ledge 70, and is positioned beneath the near side flag poles 124. The loading ramp member 156 is provided with a ramped surface $156_a$ which is generally parallel to the inner side edge portion $154_a$ of the cover member 154.

To conveniently load articles into the "flights" between adjacent pairs of the near side flag members 126, a large supply of the articles is simply placed atop the cover member 154 and then, as needed, slid downwardly off the sloped portion $154_a$ of the cover member toward the trough by an operator standing to the right of the guide shelf 72. The articles dropping off the sloped cover member portion $154_a$ fall onto the loading member ramp surface $156_a$ and drop into the trough 74 between adjacent pairs of the near side flags 126. It can readily be seen that the cover member 154 and the loading ramp member 156 completely isolate the operator's hands from the rotating drive chains 94 and 96. The unique combination of the laterally offset drive means 92 and the horizontally cantilevered pusher flags 126 permit substantially unimpeded top or side loading of the trough 74, either manually or by a suitable automated loading system.

The foregoing detailed description is to be clearly understood as being given by way of illustration and example only, the spirit and scope of the present invention being limited solely by the appended claims.

What is claimed is:

1. A method of feeding an article into the open wrapping material tube inlet end of a horizontal wrapping machine, said method comprising the steps of:

positioning the article in a stationary support surface having a forward exit and disposed rearwardly adjacent the tube inlet ends;

positioning a pusher member above said support surface and behind said article;

moving said pusher member forwardly along said support surface beside the article therealong past said exit end into the tube inlet end;

moving said pusher member upwardly without forward acceleration which would tend to accelerate the article; and moving said pusher member horizontally outwardly away from said tube inlet end prior to appreciable entry of said pusher member into the tube inlet end.

2. The method of claim 1 wherein the step of moving said pusher member upwardly without forward acceleration is compised of the step of rearwardly and upwardly pivoting said pusher member out of engagement with said article without forward acceleration which would tend to accelerate the article.

3. A method of feeding an article into an open wrapping material tube inlet end of a horizontal wrapping machine, said method comprising the steps of:

providing an elongated stationary support having a forward exit end disposed rearwardly adjacent the tube inlet end and a laterally spaced series of longitudinally extending grooves in said support surface;

providing a plurality of spaced-apart pusher member having a generally plate-like configuration with an outer end surface from which a spaced plurality of projections outwardly extend, said projections being configured for receipt and said support surface grooves;

moving the plurality of pusher member with a looped drive means forwardly along said support surface to slide article placed thereon past said exit end and into the tube inlet end; and orienting the pusher members generally vertically when sliding articles along said support surface toward the exit end, with the plurality of projections outwardly extending from the outer end surfaces of the plurality of pusher members closely mating with the support surface grooves so that small objects are not caught between said pusher members moving forwardly along the support surface and the support surface.

4. The method of claim 3 wherein:

said stationary support surface is the bottom side surface of an elongated article feed trough, and said step of moving the generally vertically oriented pusher member is performed by forwardly moving said pusher member through said elongated article feed trough.

5. A method of sequentially feeding the articles in a spaced series thereof into the open wrapping material tube inlet end of a horizontal wrapping machine, said method comprising the steps of:

positioning the open exit end of a generally horizontally disposed article feed trough closely and rearwardly adjacent the tube inlet end;

placing a series of articles to be wrapped on the bottom of the trough in a longitudinally spaced array thereon;

positioning a spaced series of pusher members to extend downwardly into said trough so that each pusher member is positioned behind and rearwardly engages one of the articles therein;

forwardly moving the pusher members through the trough to slide the articles forwardly therethrough past said open trough exit end and sequentially insert them into the tube inlet end;

rearwardly and upwardly pivoting each pusher member, as it comes into close adjacency with said open trough exit end, to disengage the pusher member from its associated article; and horizontally moving each pivoted pusher member outwardly away from the open trough exit end and the open tube inlet end.

6. The method of claim 5 wherein:

said pusher members are pusher flag members each having a pole portion having a flag portion transversely secured to an outer end thereof, and said step of positioning a spaced series of pusher members includes the step of positioning said pole portions to extend transversely over the open upper side of said trough with said flag portions extending downwardly into said trough.

7. The method of claim 6 wherein:

said steps of forwardly moving the pusher members through the trough, rearwardly and upwardly pivoting each pusher member, and horizontally moving each pivoted pusher member are performed by securing said pole portions to a looped drive structure for rotational movement therewith in a generally horizontal plane, sand pivoting each pole portion relative to said looped drive structure.

* * * * *

UNITED STATES PATENT AND TRADEMARK OFFICE

CERTIFICATE OF CORRECTION

PATENT NO. : 5,072,575

DATED : December 17, 1991

INVENTOR(S) : Lawrence D. Lakey

It is certified that error appears in the above-identified patent and that said Letters Patent is hereby corrected as shown below:

Col. 10, line 66, "2" should be --12--.
Col. 11, line 42, "said" should be --the--.
Col. 11, line 45, (1st occurrence) line 5, insert --and-- after the word "end".
Col. 11, line 61, insert --surface-- after the word "support".
Col. 11, line 66, "member" should be --members--.
Col. 12, line 4, "member" should be --members--.
Col. 12, line 66, "sand" should be --and--.

Signed and Sealed this

Twenty-third Day of March, 1993

*Attest:*

STEPHEN G. KUNIN

*Attesting Officer*

*Acting Commissioner of Patents and Trademarks*